US005165614A

United States Patent [19]

Fourche

[11] Patent Number: 5,165,614

[45] Date of Patent: Nov. 24, 1992

[54] WINDING METHOD FOR THE NON-RADIAL WINDING OF A CATHODE TUBE DEFLECTOR AND A DEFLECTOR MADE THEREBY

[75] Inventor: Jean-Pierre Fourche, Dijon, France

[73] Assignee: Videocolor, S.A., Paris, France

[21] Appl. No.: 724,434

[22] Filed: Jul. 1, 1991

Related U.S. Application Data

[63] Continuation of Ser. No. 517,512, Apr. 30, 1990, abandoned, which is a continuation of Ser. No. 171,271, Mar. 21, 1988, abandoned.

[30] Foreign Application Priority Data

Mar. 23, 1987 [FR] France ..... 87 03992

[51] Int. Cl.[5] ..... H01F 41/08

[52] U.S. Cl. ..... 242/7.03; 29/605; 242/7.07

[58] Field of Search ..... 242/4 A, 4 B, 4 BC, 242/4 R, 7.02, 7.03, 7.06, 7.07, 7.09, 7.13, 7.14, 7.15, 54 A; 29/605; 335/213

[56] References Cited

U.S. PATENT DOCUMENTS

| | | | |
|---|---|---|---|
| 2,757,073 | 8/1956 | Bugg | 242/413 X |
| 3,299,379 | 1/1967 | Torsch | 335/213 |
| 4,417,698 | 11/1983 | Pernet et al. | 242/7.14 X |
| 4,469,285 | 9/1984 | Fahrbach | 242/7.14 X |

FOREIGN PATENT DOCUMENTS

| | | | |
|---|---|---|---|
| 0039276 | 1/1981 | European Pat. Off. | 242/4 R |
| 2549639 | 1/1985 | France . | |
| 58-133744 | 8/1983 | Japan | 335/213 |

*Primary Examiner*—Daniel P. Stodola
*Assistant Examiner*—William G. Battista, Jr.
*Attorney, Agent, or Firm*—Joseph S. Tripoli; Joseph J. Laks; Daniel E. Sragow

[57] ABSTRACT

To avoid the use of adhesives or notched parts when winding the non-radial layers of a cathode tube deflector, first a radial layer with a wide pitch is wound. This first radial layer then presents notches for winding the folllowing layers of the non-radial coil.

2 Claims, 4 Drawing Sheets

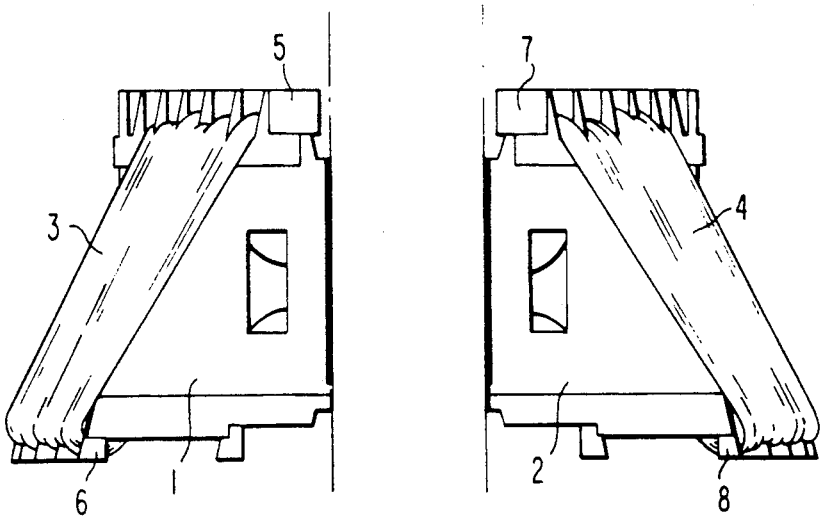
FIG. 1 PRIOR ART
FIG. 2 PRIOR ART
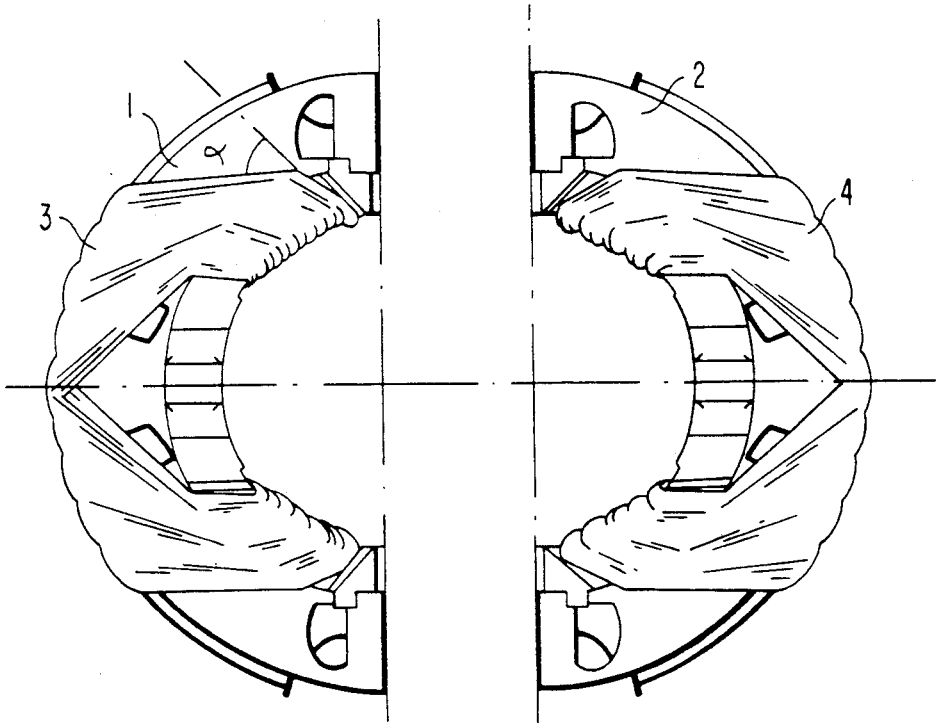

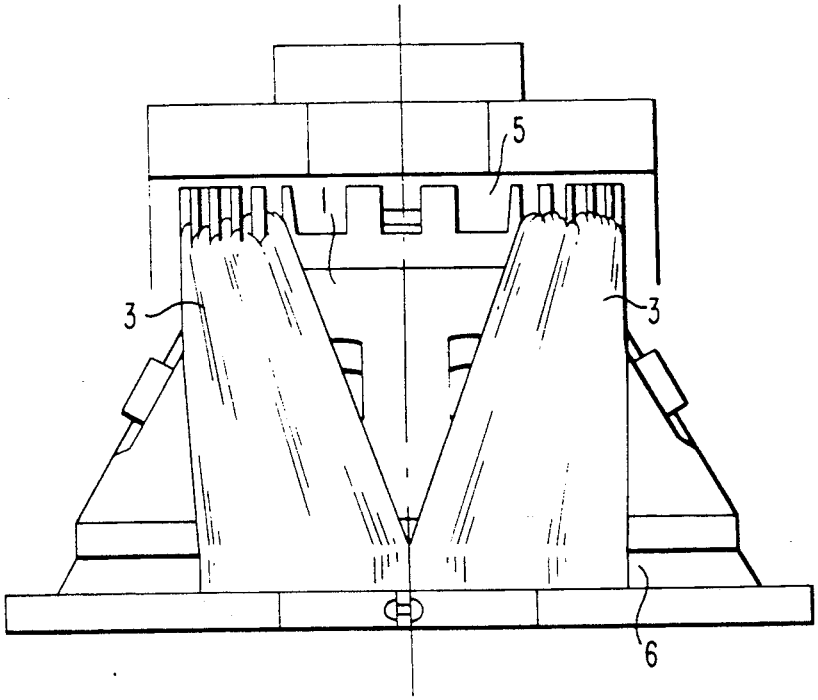
FIG. 3 PRIOR ART
FIG. 4 PRIOR ART
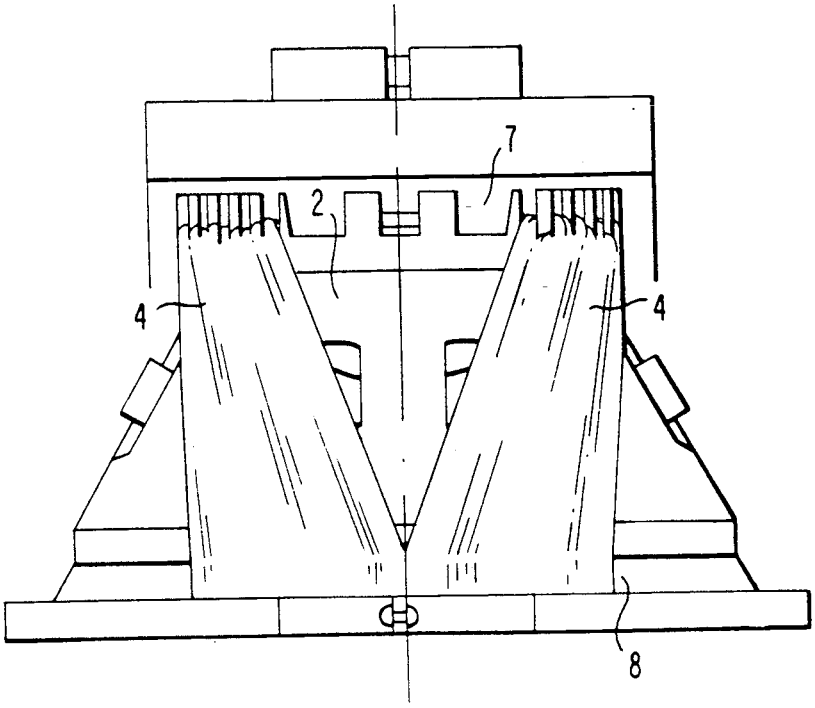

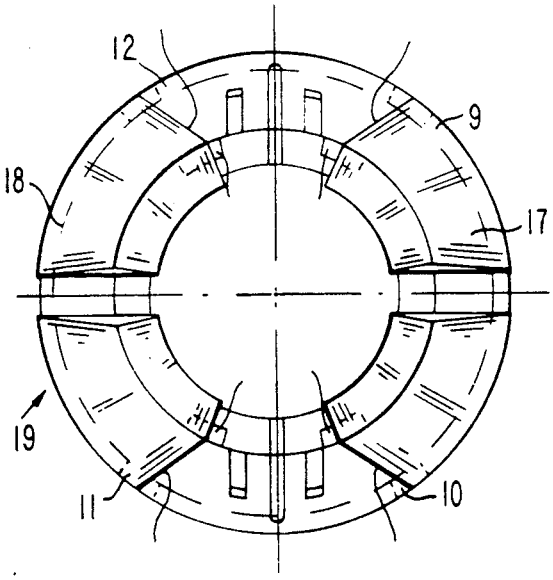
FIG. 5 PRIOR ART
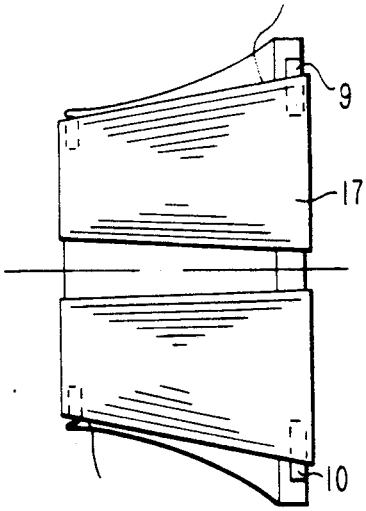
FIG. 6 PRIOR ART
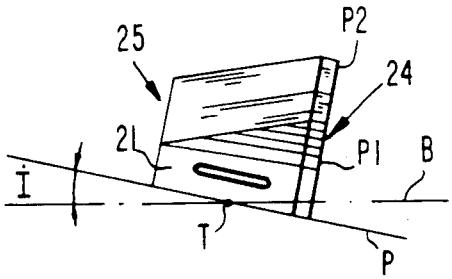
FIG. 8
FIG. 9
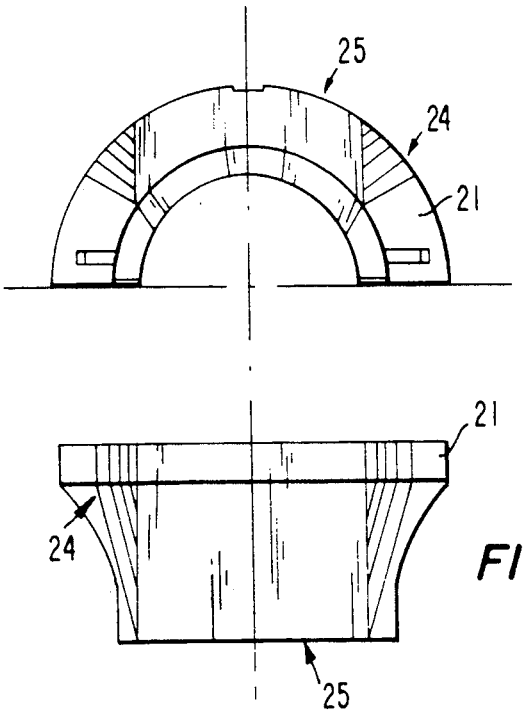
FIG. 10

WINDING METHOD FOR THE NON-RADIAL WINDING OF A CATHODE TUBE DEFLECTOR AND A DEFLECTOR MADE THEREBY

This is a continuation of application Ser. No. 517,512, filed Apr. 30, 1990, now abandoned, which is a continuation of application Ser. No. 171,271, filed on Mar. 21, 1988, now abandoned.

BACKGROUND OF THE INVENTION

1. Field of the Invention

The invention pertains to a winding method for the non-radial winding of a cathode tube deflector.

2. Description of the Prior Art

Aligned-gun trichromatic cathode tubes are presently fitted with deflectors which themselves perform the self-convergence of electron beams and correct image geometry. The line field created by saddle-shaped coils is called a "positive astigmatic" field while the frame field is called a "negative mean astigmatic" field when it ensures convergence and a "positive front astigmatic" field when it performs geometry corrections.

Several methods are used in the field of wide-audience television applications to make a frame winding according to the above-mentioned requirements: it is possible to use either a saddle-shaped coil or a doughnut coil. The doughnut coil can be made either with a radial frame that works with field formers (ferromagnetic parts attached to the deflector) or by using an inclined winding method with a rear angle greater than the front angle, a coil of this type being possibly also associated with magnetic correcting means. In this latter, widely-used method, one of the following three techniques is employed for the winding:

Plastic parts with notches are fixed to the front and rear of the ferrite core, and these notches determine the inclination of the winding wire. This method gives sharp inclinations for the wire but is expensive because it requires the use of special parts and entails additional operations to handle these parts, thus increasing production time;

The wire is wound on the bare ferrite core which may be notched, but the inclination of the wire is then greatly limited (to a maximum of about 15°), for the wire tends to slip in a generally dissymmetrical way;

Or, finally, to prevent the wire from slipping, adhesive elements are placed on the ferrite core at the front and rear planes. These elements may be adhesive tapes, glues, waxes, etc. This type of method is costly. Its automation is difficult and it does not give the wire inclinations of more than about 20°.

3. Summary of the Invention

An object of the present invention is a winding method used to obtain inclinations in the winding wire which reach about 30° at the edges of the coil, on bare ferrite cores without notches, without adding any parts or any adhesive element, the said method being easily automated.

The method according to the invention consists in making a first layer of the coil in a manner which is at least approximately radial, with a wide coil pitch and then in depositing the following non-radial layers by using at least a portion of the wires of the first layer to prevent the following layers from slipping.

BRIEF DESCRIPTION OF THE DRAWINGS

The invention will be better understood from the following description of an embodiment, taken as a non-exhaustive example, and made with reference to the following drawings of which:

FIGS. 1 to 4 are different views of a prior art frame coil using plastic notches, FIGS. 5 and 6 are front and side views of a prior art frame coil using adhesives to retain the wire, FIG. 8 is a side view of a ferrite half-core wound according to the invention during the winding of the non-radial layers, FIGS. 9 and 10 are rear and side views of a frame winding with several layers according to the invention.

DESCRIPTION OF A PREFERRED EMBODIMENT

Figure 7:
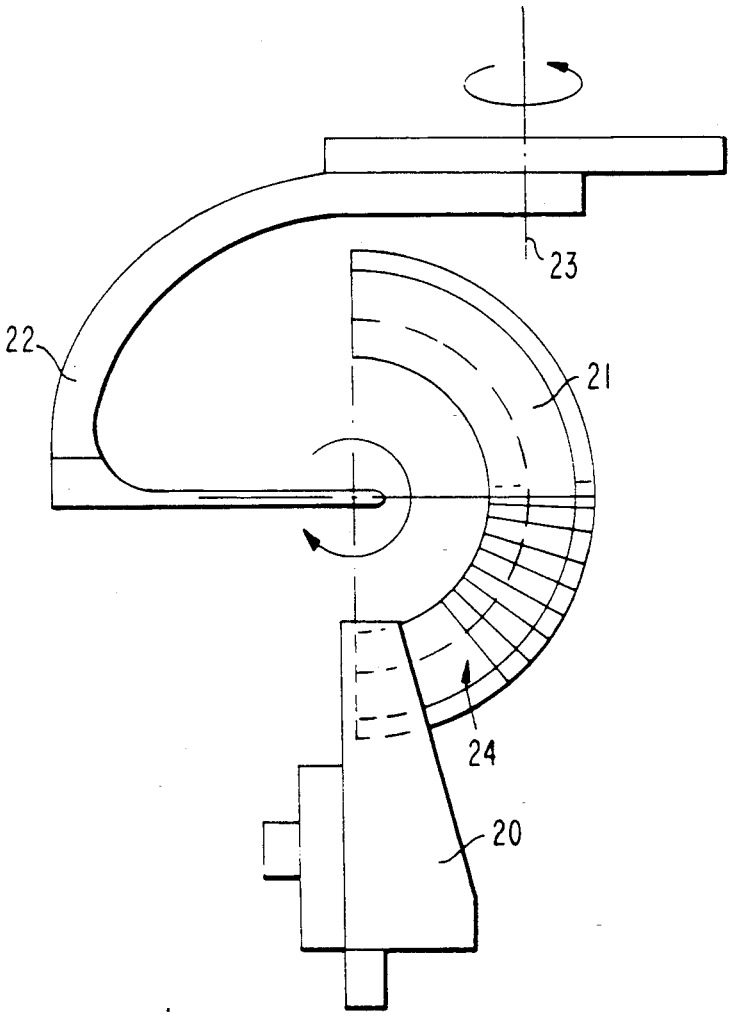
FIG. 7 is a partial top view of a conventional winding machine during the making of the first layer of the coil according to the invention.

FIGS. 1 and 2 show exploded front and rear views of the two ferrite half-cores 1, 2 each comprising a frame half-coil 3, 4. The wires of the half-coils 3, 4 are not arranged radially, i.e. they are not parallel to the generating lines of the conical surface formed by the ferrite half cores 1, 2. These wires form an angle of inclination with these generating lines which may vary according to the position of the wire strands in the coil and according to the angular position of the notches. To keep all the turns of the two half-coils in place, notched plastic parts, 5, 6 and 7, 8, are fixed on the front and rear flat sides respectively of each ferrite half-core. The successive turns of the half-coils 3, 4, are held in place by these notches, thus making it possible to wind them at a wide angle of inclination.

FIGS. 3, 4 show two side views, considered at 180° with respect to each other, of a finished deflector made with the elements of FIGS. 1 and 2.

FIGS. 5 and 6 show another embodiment of a prior art deflector. In this embodiment, eight segments of adhesive material 9 to 16, for example double-sided adhesive tape or an adhesive compound, are deposited on the front and rear flat sides of the two ferrite half-cores or near these sides at the edge of these ferrite half-cores. These segments are deposited at the ends, namely the edges, of the half-coils 17, 18 of the deflector 19 and extend outwards, slightly beyond them. For it is generally enough to immobilize the turns at the extremities of the first layer to prevent the turns of the following layer from slipping.

We shall now describe the method of the invention with reference to the FIGS. 7 to 10. The winding machine, partially shown in FIG. 7, essentially comprises a device 20 to hold the ferrite half-cores 21 and to drive them rotationally, and a rotary wire guide 22 (more commonly called a flyer), the rotational axis 23 of which is perpendicular to the axis B of the ferrite half-cores 21 in the radial winding position.

FIG. 7 shows a ferrite half-core 21 on which the flyer 22 is depositing the radial winding layer 24 at a wide pitch. Since the turns of this first layer are substantially radial (i.e. truly radial or inclined by a few degrees), they have a stable position with respect to that part of the conical ring formed by the ferrite half-core, the generating line of which is also radial. These turns are difficult to move when putting down the next non-radial layers (or at least for the second layer which guides the following layers) for which they present holding notches. Of course, the radial winding and the non-radial winding are done with the same wire without any interruption.

According to a first embodiment of the invention, the pitch (rotational angle of the ferrite core or flyer around the axis B for one turn) of this first layer 24 is constant and equal to about two to five times the pitch of a coil with close winding made with the same wire (in a close winding coil the pitch equals wire diameter).

According to a second embodiment of the invention, this pitch is variable: it has a first value P1 at the ends of the layer and a second value P2, greater than P1, in the middle of the layer. Preferably, P1 is equal to about two to five times the pitch of the close winding and P2 is equal to two to three times P1. As can be seen in FIGS. 8 to 10, the layer 24 should be sufficiently wide, especially in the rear of the ferrite core and should slightly extend (by about two to five turns) beyond the front of the following layers so that it is certain that the farthest turns of the non-radial winding will be always held in place by those of the layer 24 without its being necessary to position the first turn of the non-radial winding 25 very precisely with respect to the layer 24.

To make non-radial windings according to the invention, the ferrite half-core 21 is inclined around an axis contained in the breaking plane P (the plane of separation between two ferrite half-cores formed by the breaking of an entire ferrite core). This axis is shown in FIG. 8 by the line T (it is perpendicular to the plane of the drawing). Let B be the axis of the machine (the axis around which the machine makes the ferrite half-cores rotate to do the radial windings). The angle I formed by B and P is the angle of inclination of the ferrite core. The angles of inclination of the various turns of the non-radial winding 25 depend on the angle I and the angular position of these turns in the winding.

The angular distribution of the various turns of the resulting winding (24+25) is the composition of the distribution of the various layers, the effect of the first layer being small inasmuch as it has a small number of turns.

The mean inclination of a ferrite half-core carrying a non-radial winding made according to the invention is equivalent to the inclination obtained with a ferrite core inclined for all the turns, reduced by the fact that the first layer is not inclined. If the total winding (24+25) has N turns, and the first layer has turns, the equivalent inclination Ieq of the ferrite half-core 21 will be:

$$I\,eq = I(N-n)/N$$

I being the angle of inclination of the ferrite half-cores (FIG. 8).

For example, a coil with 440 turns in four layers at a pitch of 1°, occupying an angle of 110° at the center, on a ferrite inclined at an angle of I=20°, and made according to a prior art method, is equivalent to a coil, made according to the invention by winding a first radial layer with forty turns at a pitch of 3.4° (hence occupying an angle of about 136° at the center) on which four non-radial layers with about 100 turns each are wound at a pitch of 1.1° on a ferrite inclined by I'=22°.

Furthermore, it is advantageous for the coil pitch of the non-radial layers to be greater than that pitch which would be obtained without the first radial layer, so as to enable the wires of this first layer to be interposed in the turns of the following layers of the coil without excessively disturbing their arrangement.

The method of the present invention can be used when it is desired to obtain a coil with a front "spread" angle (the angle at the center formed by the two farthest turns of the coil, in a plane. PA perpendicular to the axis of the ferrite core) is greater than the rear "spread" angle (i.e. for a plane PA passing through the front flat side or rear flat side respectively of the ferrite), and when this is sought to be done with a first radial layer (such as the said layer 24). After winding the first layer, the ferrite half-core is inclined in a direction opposite to the one shown in FIG. 8. This type of winding is especially useful to make an auto-convergent deflector giving an image with a very uniform definition.

What is claimed is:

1. A winding method for the non-radial winding of wires to form a coil for a cathode tube deflector wherein said cathode tube deflector has at least a first half-core, wherein said at least first half-core has a center of radius, said method comprising the steps of:

winding a first layer of said coil which is substantially radial to said center, at a pitch which is greater in the middle of said first layer than at the ends of said layer; and winding a non-radial second layer on said first layer, wherein at least a portion of said wires in said first layer prevent said second layer from slipping.

2. A deflector for a cathode ray tube comprising:

a toroidal winding wound on a core, said winding having a substantially radially wound first layer on said core, and a second layer wound on said first layer, said second layer being non-radial, said first layer having a pitch which is greater in the middle of said layer than at the ends of said layer.

* * * * *